US006026575A

United States Patent [19]

Wonderley

[11] Patent Number: 6,026,575

[45] Date of Patent: Feb. 22, 2000

[54] UTILITY KNIFE HANDLE

[75] Inventor: Jeffrey W. Wonderley, Fort Defiance, Va.

[73] Assignee: American Safety Razor Company, Staunton, Va.

[21] Appl. No.: 09/126,275

[22] Filed: Jul. 30, 1998

Related U.S. Application Data

[60] Provisional application No. 60/065,796, Nov. 14, 1997.

[51] Int. Cl.[7] ..... B26B 5/00

[52] U.S. Cl. ..... 30/125; 30/330; 30/332; 30/339

[58] Field of Search ..... 30/125, 162, 329, 30/330, 332, 337, 339

[56] References Cited

U.S. PATENT DOCUMENTS

| | | | |
|---|---|---|---|
| 3,604,113 | 9/1971 | Cuscovitch | 30/337 |
| 3,660,895 | 5/1972 | West | 30/332 |
| 4,068,375 | 1/1978 | Rathbun et al. | 30/125 |
| 4,604,805 | 8/1986 | Krieger | 30/330 |
| 4,713,884 | 12/1987 | Dunnagan | 30/339 |
| 5,042,154 | 8/1991 | Gilbert | 30/125 |
| 5,301,428 | 4/1994 | Wilcox | 30/125 |
| 5,404,645 | 4/1995 | Janser | 30/125 |

*Primary Examiner*—Hwei-Siu Payer

*Attorney, Agent, or Firm*—McDermott, Will & Emery

[57] ABSTRACT

A utility knife handle including a first body, or first shell, adjustably mated to a second body, or second shell, to form a blade holding portion and a blade storing portion. The first and second bodies have mating beveled surfaces adapted to align the first body with the second body when they are joined. In the preferred embodiment the first body is connected to the second body by a control knob adapted to allow for linear and pivotal adjustment between the first and second bodies. The utility knife handle is adjustable between an open position in which the holding portion and the storing portion allow the removal of any blades therein, an intermediate position in which the holding portion prevents removal of any blades therein and allows for positional adjustment of blades therein and the storing portion prevents the removal of any blades therein, and a closed position in which the holding portion prevents movement of any blades therein and the storing portion prevents the removal of any blades therein. The storing portion is adapted to receive and store extra blades in a secure manner. The holding portion is adapted to hold a blade in an operating position and to allow the blade to be adjusted between two positively locked positions. The holding portion of the first body preferably has a first key and a lower second key adapted to extend through an aperture in a blade positioned thereon and into a groove in the holding portion of the second body.

17 Claims, 6 Drawing Sheets

UTILITY KNIFE HANDLE

REFERENCE TO RELATED APPLICATIONS

The present application is based on provisional patent application Ser. No. 60/065,796, filed on Nov. 14, 1997, entitled METAL CARPET KNIFE, with named inventor Jeffrey W. Wonderley.

FIELD OF THE INVENTION

The present invention relates to a tool handle, and more specifically to a utility knife handle having various safety features.

BACKGROUND OF THE INVENTION

Utility knife handles are devices devised to hold a razor blade and to allow a user to grasp the handle and cut an object, such as carpet, using the razor blade. In order to manufacture a utility knife handle that is successful in the market place, the handle should be both safe and easy to use. Since razor blades are inherently dangerous tools, the construction of a utility knife handle requires the integration of a number of safety features to insure the user of the utility knife handle is not injured by a razor blade held within the handle. The utility knife handle should also be configured to allow for the easy adjustment or removal of a blade, while not sacrificing the safety features of the handle.

Utility knife handles that lack sufficient safety features place the user at risk of serious injury. A utility knife having a blade not properly secured within the handle can lead to injury of the user if the blade becomes dislodged from the handle. Similarly, a utility knife handle having a feature wherein the position of the blade may be adjusted can lead to injury if the blade unexpectedly moves while in use. Utility knife handles equipped with a feature to store additional blades within the handle can be dangerous if the stored blades are insufficiently secured in a safe place.

A delicate balance should be drawn between constructing a utility knife handle having numerous safety features to allow safe operation thereof under any circumstance, and a utility knife handle that is easy to use and is not overburdened with safety features. Utility knife handles should not be configured such that the blades are difficult to adjust or remove when necessary. Additionally, utility knife handles should not allow blades stored therein to become dislodged during adjustment of the blade. Utility knife handles should not require the use of separate tools, such as a screwdriver, to adjust or remove the blades, which will thereby increase the speed and ease by which blades are adjusted or removed from the handle.

Consequently, there is a need for a utility knife constructed to allow the easy and safe adjustment or removal of a razor blade from the operating position and the easy and safe storage of extra razor blades.

SUMMARY OF THE INVENTION

The present invention provides a mechanism overcoming the problems discussed above with regards to safety and ease of use. There is a need for a utility knife constructed to allow the easy and safe adjustment or removal of a razor blade from the operating position and the easy and safe storage of extra razor blades.

The present invention advantageously provides a utility knife handle including a first body, or first shell, adjustably mated, or connected, to a second body, or second shell, to form a blade holding portion located at a first end of the utility knife handle and a blade storing portion located at a second end. The first shell and the second shell having mating beveled surfaces adapted to automatically align the first shell with the second shell when the first shell and the second shell are joined. In the preferred embodiment the first shell is connected to the second shell at a position between the blade holding portion and the blade storing portion by a control knob having a threaded rod extending therefrom. The threaded rod of the control knob extends through an aperture in the second shell and engages a threaded hole on the first shell. The control knob mates the first shell with the second shell such that the first shell and the second shell may be easily adjusted linearly and pivotally with respect to one another.

The utility knife handle of the present invention is adapted to be easily adjustable between three separate positions. The first position is an open position in which the first shell and the second shell are substantially disengaged from one another and the blade holding portion and the blade storing portion allow the removal of any blades therein. The second position is an intermediate position in which the first shell and the second shell are partially engaged to one another and the blade holding portion prevents removal of any blades therein and allows for positional adjustment of blades therein and the blade storing portion prevents the removal of any blades therein. The intermediate position allows for the easy adjustment of the blade being used in an operational position, while maintaining the safety of the utility knife handle by preventing stored blades from accidentally dislodging from the blade storing portion and potentially causing harm to the user. And finally, the third position is a closed position or safe operating position in which the first shell and the second shell are fully engaged to one another and the blade holding portion prevents movement of any blades therein and the blade storing portion prevents the removal of any blades therein.

Preferably, the blade storing portion of the utility knife handle is an internal cavity within the handle adapted to receive and store extra blades in a secure and safe manner. In the preferred embodiment the blade storing portion of the first shell has a protruding member adapted to extend through an aperture in a blade to a predetermined height. The blade storing portion of the second shell has a recessed portion adapted to receive the protruding member when the utility knife handle is in the closed position. Additionally, the recessed portion of the second shell is adapted to receive the protruding member when the utility knife handle is in the intermediate position in order to prevent the stored blades from exiting the blade storing portion and potentially injuring the user. The first shell includes peripheral walls about the blade storing portion that extend to a height substantially equivalent to the height of the protruding member, which further reduce the chance of a loose stored blade unexpectedly exiting the blade storing portion. The blade storing portion of the first shell includes an alignment member having a beveled terminal end surface adapted to mate with a hole on the blade storing portion of the second shell and align the alignment member within the hole when the first shell and the second shell are joined.

The blade holding portion of the present invention is located at a first end of the utility knife handle and preferably is adapted to hold a blade in an operating position and to allow the blade to be adjusted between two positively locked safe operating positions. In the preferred embodiment the blade holding portion of the first shell preferably has a first key adapted to extend through an aperture in a blade positioned thereon and the blade holding portion of the second shell has a first stop adapted to abut a rear edge of the blade when the blade is positioned on the first key. The blade holding portion of the second shell has a groove adapted to receive the first key when the utility knife handle is in the closed position. The blade holding portion of the first shell also includes a second key adapted to extend through the aperture in the blade positioned thereon to a height below a height of the first key. The groove on the second shell is adapted to receive the second key when the utility knife handle is in the closed position, and is adapted to receive the first key when the utility knife handle is in the intermediate position. The blade holding portion of the first shell also includes a second stop adapted to abut the rear edge of the blade when the blade is positioned on the second key.

Additional advantages and other features of the invention will be set forth in part in the description which follows and in part will become apparent to those having ordinary skill in the art upon examination of the following or may be learned from the practice of the invention. The advantages of the invention may be realized and obtained as particularly pointed out in the appended claims.

DETAILED DESCRIPTION OF THE INVENTION

Figure 1:
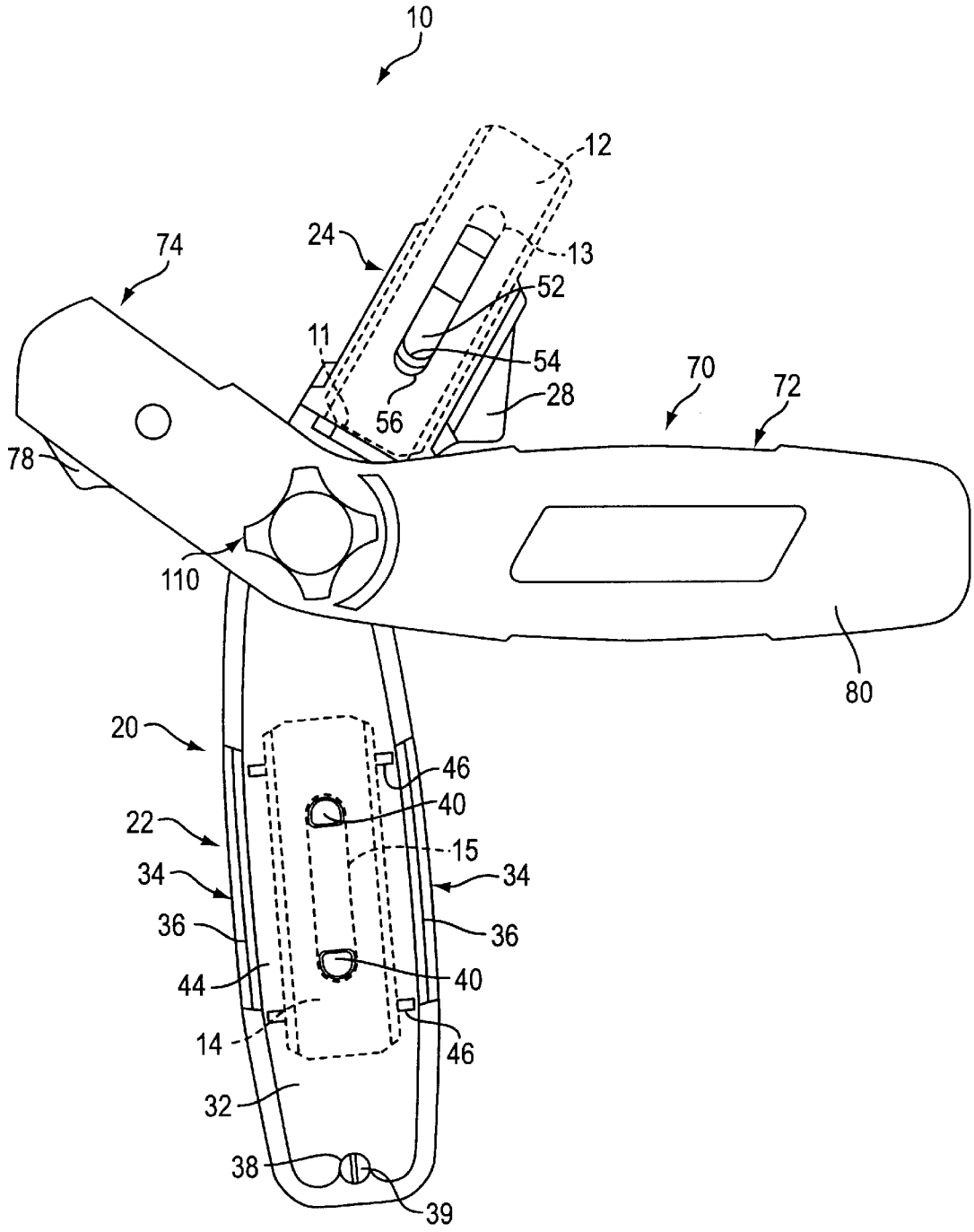
FIG. 1 is a top view of a utility knife handle according to an embodiment of the present invention with a first shell pivoted in relation to the second shell such that the utility knife handle is in an open position.
Figure 2:
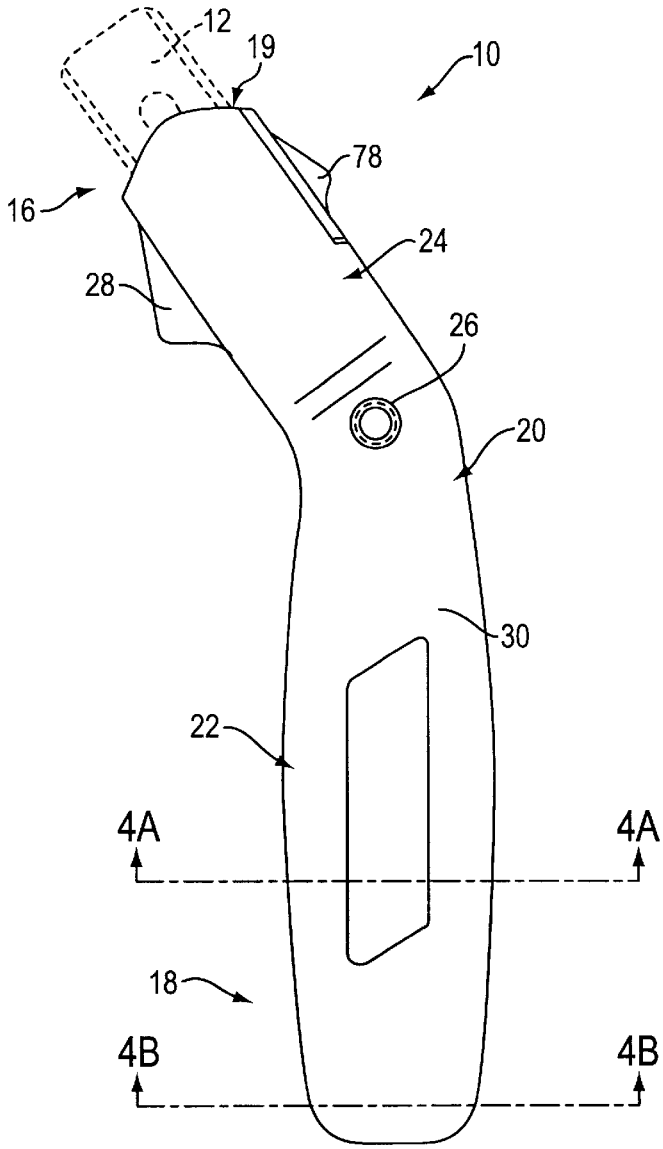
FIG. 2 is a bottom view of a utility knife handle according to an embodiment of the present invention.

The preferred embodiment of the present invention generally relates to a utility knife handle 10 as depicted in FIGS. 1 and 2. The utility knife handle 10 generally includes a first body or first shell 20 adjustably mated, or connected, to a second body or second shell 70. The first shell 20 has a blade storing portion 22 and a blade holding portion 24 and the second shell 70 has a blade storing portion 72 and a blade holding portion 74. In the preferred embodiment the first shell 20 is connected to the second shell 70 at a position between the blade holding portions and the blade storing portions by a control knob 110 used to control the positional relationship between the first shell 20 and the second shell 70.

Figure 8A:
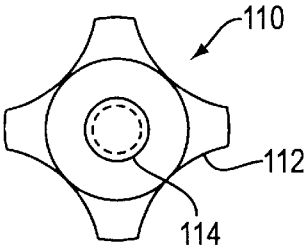
FIG. 8A is a bottom view of a control knob of a utility knife handle according to an embodiment of the present invention.
Figure 8B:
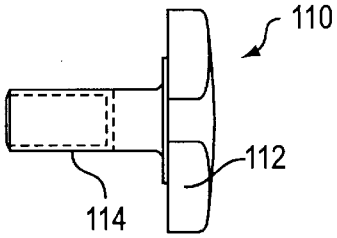
FIG. 8B is a side view of a control knob of a utility knife handle according to an embodiment of the present invention.
Figure 8C:
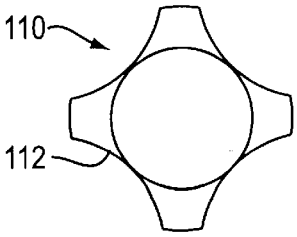
FIG. 8C is a top view of a control knob of a utility knife handle according to an embodiment of the present invention.

In the preferred embodiment, the first shell 20 is connected to the second shell 70 by a control knob 110 (depicted in detail in FIGS. 8A–8C) having finger engaging surfaces 112 about the perimeter thereof, and a threaded rod 114 extending therefrom. The threaded rod 114 of the control knob 110 extends through an aperture 76 in the second shell 70 and engages a threaded hole 26 on the first shell 20. The control knob 110 mates the first shell 20 with the second shell 70 such that the first shell 20 and the second shell 70 may be adjusted linearly and pivotally with respect to one another. As the control knob 110 is rotated, the first shell 20 is either going to be forced towards the second shell 70 or away from the second shell 70, depending on the direction of rotation and the threaded relationship between the rod 114 and hole 26. As the control knob 110 is rotated and the first shell 20 begins to linearly move away from the second shell 70, the first and second shells, 20 and 70, will reach a point where they may be pivoted with respect to each other about the rod 114.

Figure 3A:
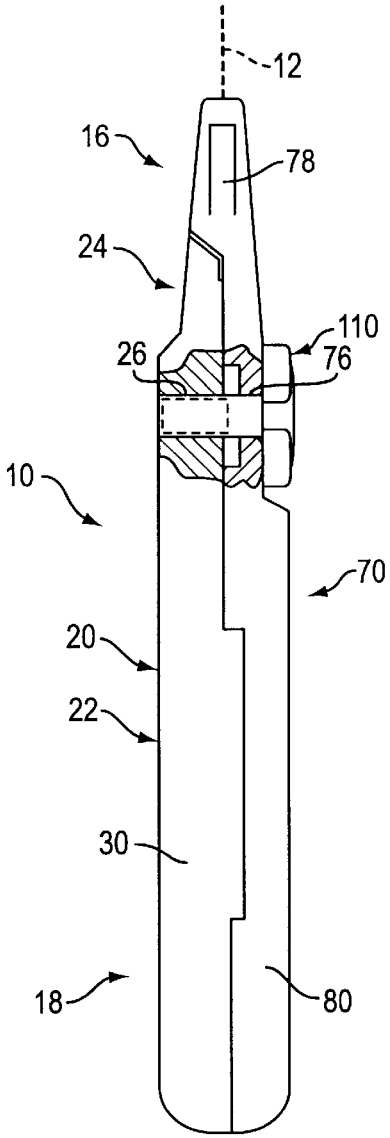
FIG. 3A is a partial cross-sectional, left side view of a utility knife handle according to an embodiment of the present invention with the utility knife in a closed position.
Figure 3B:
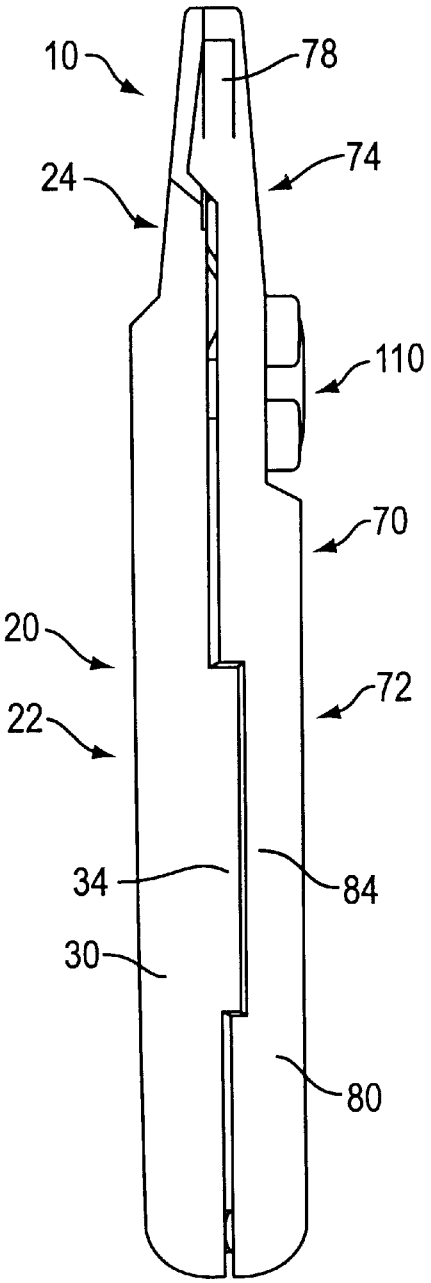
FIG. 3B is a left side view of a utility knife handle according to an embodiment of the present invention with the utility knife in an intermediate position.
Figure 3C:
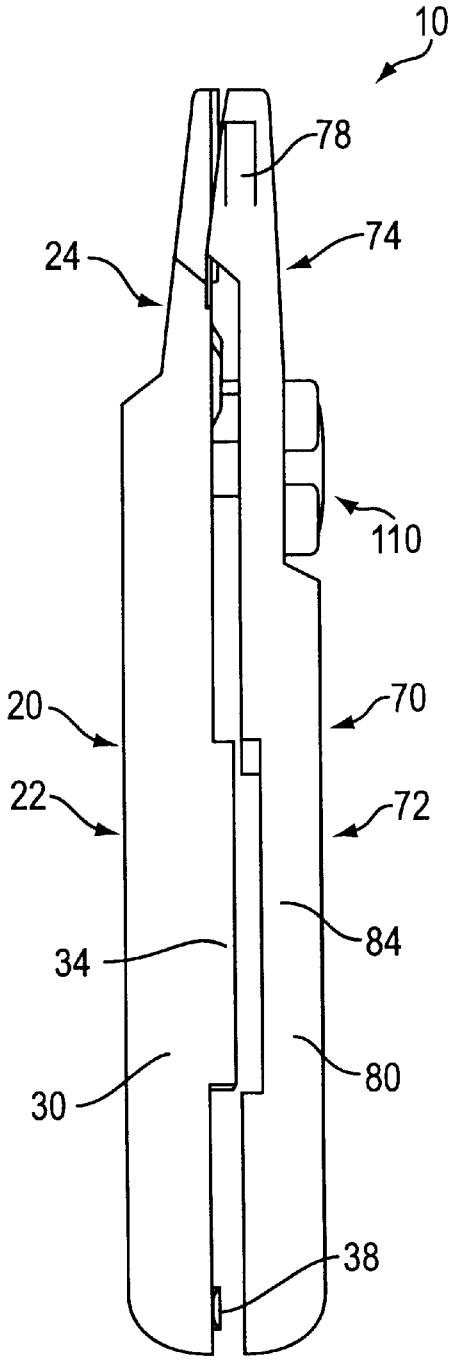
FIG. 3C is a left side view of a utility knife handle according to an embodiment of the present invention with the utility knife in an open position.
Figure 5B:
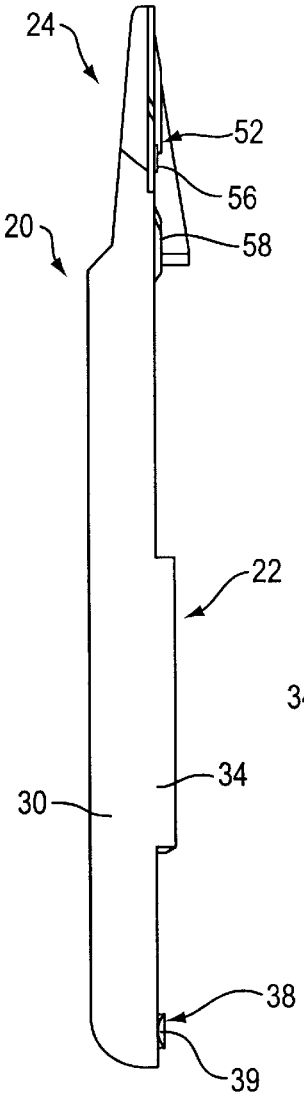
FIG. 5B is a side view of a first shell of a utility knife handle according to an embodiment of the present invention.
Figure 5A:
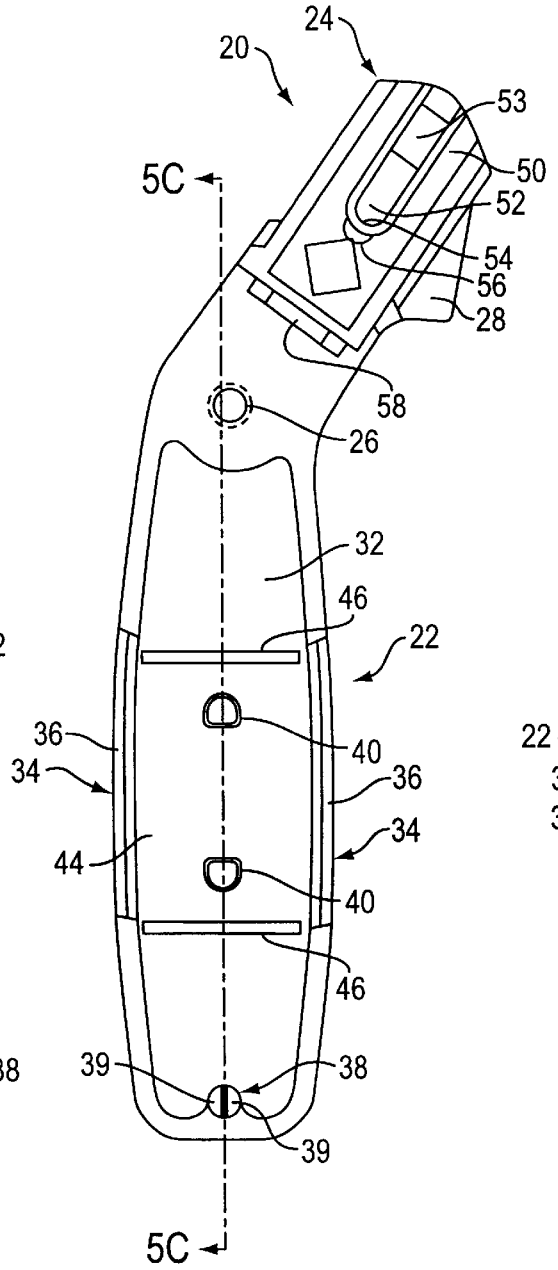
FIG. 5A is a top view of a first shell of a utility knife handle according to an embodiment of the present invention.
Figure 5C:
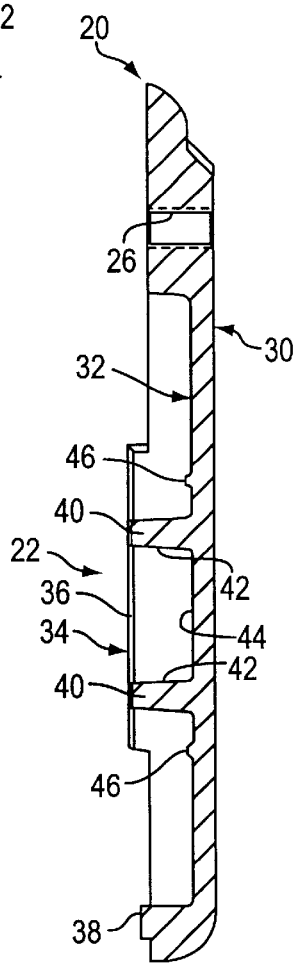
FIG. 5C is a cross-sectional view of a first shell of a utility knife handle according to an embodiment of the present invention taken along line 5C—5C of FIG. 5A.
Figure 6B:
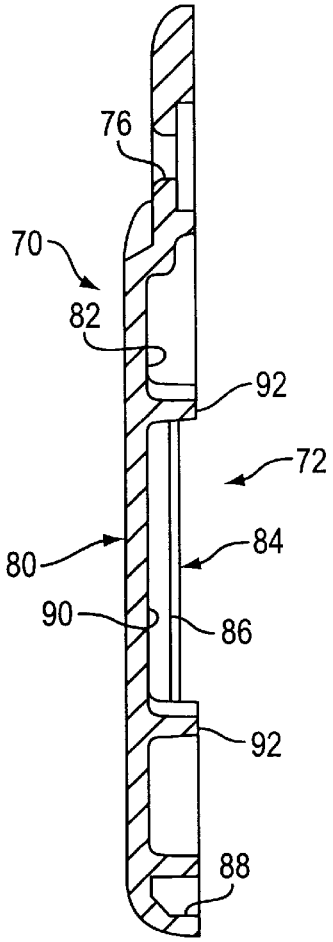
FIG. 6B is a cross-sectional view of a second shell of a utility knife handle according to an embodiment of the present invention taken along line 6B—6B of FIG. 6A.
Figure 6A:
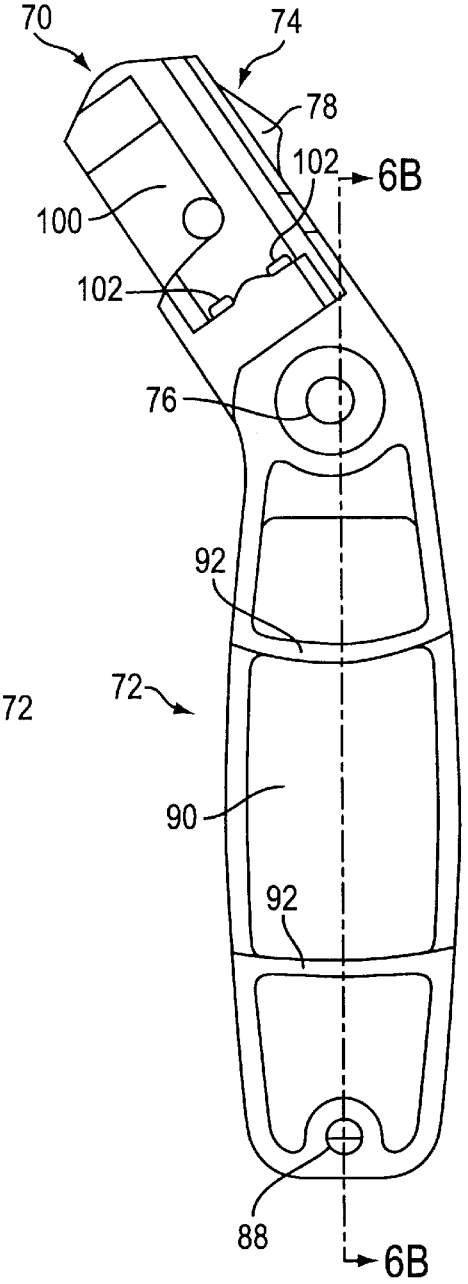
FIG. 6A is a bottom view of a second shell of a utility knife handle according to an embodiment of the present invention.
Figure 6C:
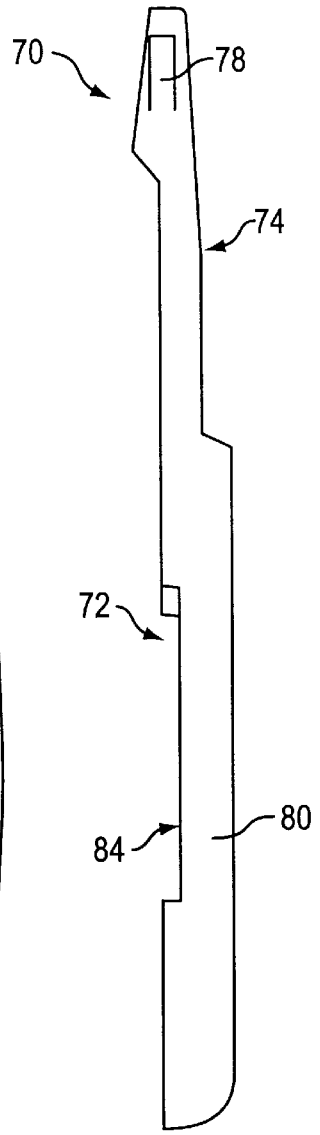
FIG. 6C is a side view of a second shell of a utility knife handle according to an embodiment of the present invention.

The utility knife handle 10 of the present invention is adapted to be adjustable between three separate positions, depicted in FIGS. 3A–3C. The first position is an open position, depicted in various configurations in FIGS. 1 and 3C, in which the first shell 20 and the second shell 70 are substantially disengaged from one another and the blade holding portions, 24 and 74, and the blade storing portions, 22 and 72, allow the removal of any blades therein. In the first position the first shell 20 and the second shell 70 are joined or connected by the rod 114 and control knob 110. In the open position, the first shell 20 and the second shell 70 may be pivoted with respect to each other about the rod 114. The open position allows the user to have generally unrestricted access to blades 12 within the blade holding portions, 24 and 74, and blades 14 within the blade storing portions, 22 and 72.

The second position is an intermediate position, depicted in FIG. 3B, in which the first shell 20 and the second shell 70 are partially engaged to one another and the blade holding portions, 24 and 74, prevent removal of any blades therein and allows for positional adjustment of blades therein and the blade storing portions, 22 and 72, prevent the removal of any blades therein. The intermediate position allows for the adjustment of the blade 12 being used in an operational position, while maintaining the safety of the utility knife handle by preventing stored blades 14 from accidentally dislodging from the blade storing portions 22 and 72, and potentially causing harm to the user. In the first position the first shell 20 and the second shell 70 are joined or connected by the rod 114 and control knob 110. In the intermediate position, the first shell 20 and the second shell 70 are prevented from pivoting with respect to each other about the rod 114 due to interference between various parts of the first and second shells, 20 and 70, for example alignment pin 38 and hole 88.

And finally, the third position is a closed position, depicted in FIG. 3A, in which the first shell 20 and the second shell 70 are fully engaged to one another and the blade holding portions, 24 and 74, prevent movement of any blades therein and the blade storing portions, 22 and 72, prevent the removal of any blades therein. In the closed position, the first shell 20 and the second shell 70 are prevented from pivoting with respect to each other about the rod 114 due to interference between various parts of the first and second shells, 20 and 70, for example alignment pin 38 and hole 88.

Figure 4A:
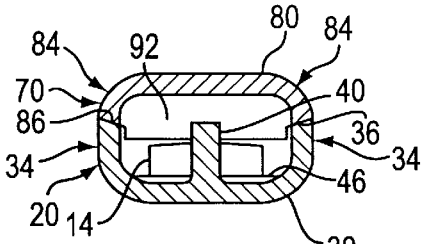
FIG. 4A is a cross-sectional view of a utility knife handle according to an embodiment of the present invention taken along line 4A—4A of FIG. 2, depicting a blade storing portion thereof.

Referring generally to FIGS. 5A–5C and 6A–6C, the blade storing portions, 22 and 72, of the utility knife handle preferably form an internal cavity within the handle at a second end 18 thereof and are adapted to receive and store extra blades 14 in a secure manner. In the preferred embodiment, the blade storing portion 22 of the first shell 20 has an outer surface 30 that engages the hand of a user and an internal cavity 32. The blade storing portion 22 of the first shell 20 has an inner surface 44 and one or more protruding members 40 adapted to extend through an aperture 15 in a blade 14 to a predetermined height above the inner surface 44. The protruding members 40 preferably have tapered side surfaces 42 such that the aperture 15 of the blades 14 fit easily on the terminal ends of the protruding members 40 and the aperture 15 becomes wedged on the wider base of the protruding members 40 near the inner surface 44. One or more rails 46 are positioned on the inner surface 44 near the protruding members 40 in order to act as a raised surface upon which the blades 14 can rest in the blade storing portion 22 as depicted in FIG. 4A. The rails 46 create a gap below the blades 14, thereby making it easier to remove the blades 14 from the blade storing portion 22.

Figure 4B:
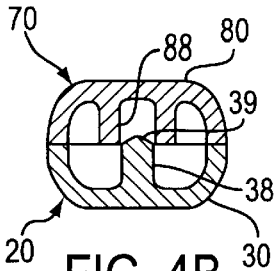
FIG. 4B is a cross-sectional view of a utility knife handle according to an embodiment of the present invention taken along line 4B—4B of FIG. 2, depicting an alignment member and corresponding hole.

The first shell 20 includes peripheral walls 34 about the blade storing portion 22 that extend to a height substantially equivalent to the height of the protruding member 40. The walls 34 reduce the chance of a loose stored blade unexpectedly exiting the blade storing portions, 22 and 72. The first shell 20 has beveled surfaces 36 on the end of walls 34 that are adapted, in conjunction with beveled surfaces 86 on the second shell 70, to align the first shell 20 with the second shell 70 when the first shell 20 and the second shell 70 are joined. As the control knob 110 is rotated such that the first shell 20 and the second shell 70 are moved from the intermediate position to the closed position, the beveled surfaces 36 and 86 mate and force the first shell 20 and the second shell 70 into alignment with one another. As depicted in FIG. 4B, the blade storing portion 22 of the first shell 20 includes an alignment member 38 having a beveled terminal end surface(s) 39 adapted to mate with a hole 88 on the blade storing portion 72 of the second shell 70 and align the alignment member 38 within the hole 88 when the first shell 20 and the second shell 70 are joined.

In the preferred embodiment, the blade storing portion 72 of the second shell 70 has an outer surface 80 that engages the hand of a user and an internal cavity 82. The blade storing portion 72 of the second shell 70 has a recessed portion 90 adapted to receive the protruding member 40 when the utility knife handle is in the closed position. Additionally, the recessed portion 90 of the second shell 70 is adapted to receive the protruding member 40 when the utility knife handle is in the intermediate position in order to prevent the stored blades 14 from exiting the blade storing portions, 22 and 72, and potentially injuring the user. As depicted in FIG. 4A, the recessed portion 90 has peripheral walls 92 that effectively extend within the inner cavity 32 of the first shell 20 to prevent blades 14 from exiting the blade storage portions, 22 and 72. The peripheral walls 92 may be configured to extend to a position directly above the blades 14 while in the intermediate and closed positions in order to prevent the blades 14 from sliding off the protruding members 40.

The second shell 70 includes peripheral walls 84 about the blade storing portion 72 that are recessed slightly. The walls 84, in conjunction with walls 34, reduce the chance of a loose stored blade unexpectedly exiting the blade storing portions, 22 and 72. The second shell 70 has beveled surfaces 86 on the end of walls 84 that are adapted, in conjunction with beveled surfaces 36 on the first shell 20, to align the first shell 20 with the second shell 70 when the first shell 20 and the second shell 70 are joined. As noted above, the blade storing portion 72 of the second shell 70 includes a hole 88 adapted to mate with an alignment member 38 having a beveled terminal end surface(s) 39 when the first shell 20 and the second shell 70 are joined.

Referring now to FIGS. 5A–5C, 6A–6C, and 7A–7B, the blade holding portions, 24 and 74, of the present invention are located at a first end 16 of the utility knife handle 10. The blade holding portions, 24 and 74, each have a protective member, 28 and 78, respectively, located adjacent a blade opening 19 on the first end 16 of the handle 10. The protective members, 28 and 78, are safety features constructed to extend above the outer surfaces, 30 and 80, of the first shell 20 and the second shell 70, respectively, and prevent a user's fingers from sliding off of the handle 10 and onto the blade 12.

Figure 7A:
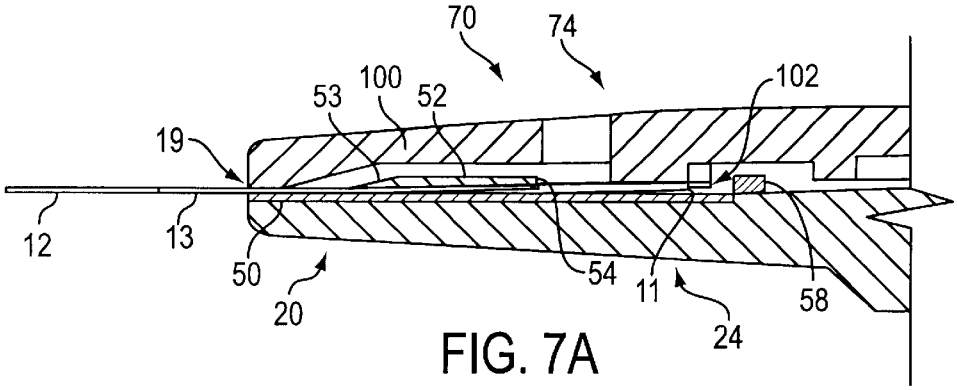
FIG. 7A is an enlarged, partial, cross-sectional view of a blade holding portion of a utility knife according to an embodiment of the present invention with the blade in a forward operational position.

The blade holding portions, 24 and 74, are adapted to hold a blade 12 in an operating position and to allow the blade 12 to be adjusted between two positively locked positions. In the preferred embodiment the blade holding portion 24 of the first shell 20 preferably has a first key 52 adapted to extend through an aperture 13 in a blade 12 positioned thereon and the blade holding portion 74 of the second shell 70 has a first stop 102 adapted to abut a rear edge of the blade 12 when the blade 12 is positioned on the first key 52. The first key 52 and the first stop 102 define a forward positively locked position with the first key 52 preventing the blade 12 from sliding forward and out of the handle 10, and the first stop 102 preventing the blade 12 from sliding rearward within the handle 10. In order to place a blade 12 in the forward locked position, the blade 12 is positioned upon the first key 52 with the aperture 13 of the blade 12 sitting flush against a rear edge 54 of the first key 52 and a rear edge 11 of the blade sitting flush against the first stop 102, as depicted in FIG. 7A.

Figure 7B:
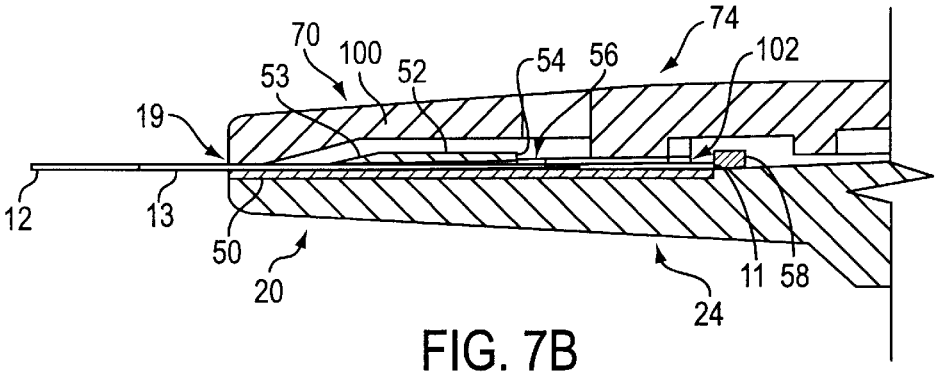
FIG. 7B is an enlarged, partial, cross-sectional view of a blade holding portion of a utility knife according to an embodiment of the present invention with the blade in a rearward operational position.

In the preferred embodiment, the blade holding portion 24 of the first shell 20 also includes a second key 56 adapted to extend through the aperture 13 in the blade 12 positioned thereon to a height below a height of the first key 52. The blade holding portion 24 of the first shell 20 also includes a second stop 58 adapted to abut the rear edge of the blade 14 when the blade is positioned on the second key 56. The second key 56 and the second stop 58 define a rearward positively locked position with the second key 56 preventing the blade 12 from sliding forward and out of the handle 10, and the second stop 58 preventing the blade 12 from sliding rearward within the handle 10. In order to place a blade 12 in the rearward locked position, the blade 12 is positioned upon the second key 56 with the aperture 13 of the blade 12 sitting flush against the second key 56 and a rear edge 11 of the blade sitting flush against the second stop 58, as depicted in FIG. 7B.

The blade holding portion 74 of the second shell 70 has a groove 100 adapted to receive the first key 52 when the utility knife handle is in the closed position and when the utility knife handle is in the intermediate position. The groove 100 on the second shell 70 is adapted to receive the second key 56 when the utility knife handle is in the closed position, however, the groove 100 is not adapted to receive the second key 56 when the utility knife handle is in the intermediate position. The groove 100 prevents the removal of the blade 12 from either the first key 52 or the second key 56 when the utility knife handle is in the closed position (depicted in FIG. 3A) and allows the blade 12 to be removed from either the first key 52 or the second key 56 when the utility knife handle is in the open position (depicted in FIGS. 1 and 3C). However, the groove 100 allows the movement of the blade 12 from the forward position on the first key 52 to the rearward position on the second key 56 when the utility knife handle is in the intermediate position (depicted in FIG. 3B), and yet prevents the blade 12 from being removed from the first key 52 when the utility knife is in the intermediate position. The configuration of the groove 100 and keys, 52 and 56, in the intermediate position allows for the adjustment of the blade 12 being used in an operational position, while maintaining the safety of the utility knife handle by preventing stored blades 14 from accidentally dislodging from the blade storing portions 22 and 72, and potentially causing harm to the user.

When the blade 12 is being used to cut an object the utility knife handle should be in the closed position with the control knob 110 rotated such that the first shell 20 and the second shell 70 are held tightly together. In the closed position, the first shell 20 and the second shell 70 clamp down on the blade 12 and prevent any movement of the blade 12.

The various parts of the utility knife handle 10 of the present invention can be made from various types of materials, such as plastics, ceramics, polymers, rubber, metal, wood, composite materials, etc.

The present invention satisfies the need for a utility knife constructed to allow the easy and safe adjustment or removal of a razor blade from the operating position and the easy and safe storage of extra razor blades.

In the previous descriptions, numerous specific details are set forth, such as specific materials, structures, chemicals, processes, etc., in order to provide a thorough understanding of the present invention. However, as one having ordinary skill in the art would recognize, the present invention can be practiced without resorting to the details specifically set forth. In other instances, well known processing structures have not been described in detail in order not to unnecessarily obscure the present invention.

Only the preferred embodiment of the invention and an example of its versatility are shown and described in the present disclosure. It is to be understood that the invention is capable of use in various other combinations and environments and is capable of changes or modifications within the scope of the inventive concept as expressed herein.

What is claimed is:

1. A utility knife handle comprising:

a first body having a blade storing portion and a blade holding portion, said first body having a beveled surface;

a second body adjustably connected to said first body, said second body having a blade storing portion and a blade holding portion corresponding to said blade storing portion and said blade holding portion of said first body, said second body having a beveled surface adapted to mate with said beveled surface of said first body and align said second body with said first body when said first body and said second body are joined; wherein:

said blade holding portion of said first body has a first key adapted to extend through an aperture in a blade positioned thereon;

said blade holding portion of said second body has a groove adapted to receive said first key when said utility knife handle is in a closed position in which said first body and said second body are fully engaged to one another;

said blade holding portion of said first body has a second key adapted to extend through the aperture in the blade positioned thereon, said second key extending to a height below a height of said first key;

said groove being adapted to receive said second key when said utility knife handle is in the closed position; and said groove being adapted to receive said first key when said utility knife handle is in an intermediate position in which said first body and said second body are partially engaged to one another.

2. A utility knife handle comprising:

a first body having a blade storing portion and a blade holding portion, said first body having a beveled surface;

a second body adjustably connected to said first body, said second body having a blade storing portion and a blade holding portion corresponding to said blade storing portion and said blade holding portion of said first body, said second body having a beveled surface adapted to mate with said beveled surface of said first body and align said second body with said first body when said first body and said second body are joined; wherein:

said blade holding portion of said first body has a first key adapted to extend through an aperture in a blade positioned thereon;

said blade holding portion of said second body has a groove adapted to receive said first key when said utility knife handle is in a closed position in which said first body and said second body are fully engaged to one another; and said blade holding portion of said second body has a first stop adapted to abut a rear edge of the blade when the blade is positioned on said first key.

3. The utility knife handle of claim 1 or 2, wherein said first body is pivotally connected to said second body.

4. The utility knife handle of claim 1 or 2, wherein said first body is adjustably connected to said second body by a control knob having a threaded rod extending therefrom, said rod extending through an aperture in said second body and engaging a threaded hole on said first body.

5. The utility knife handle of claim 1 or 2, wherein said control knob is positioned between said blade holding portion of said first body and said blade holding portion of said second body.

6. The utility knife handle of claim 1 or 2, wherein said second body is adjustably connected to said first body by manually operable connection means which enables said utility knife handle to have:

an open position in which said first body and said second body are substantially disengaged from one another;

an intermediate position in which said first body and said second body are partially engaged to one another; and a closed position in which said first body and said second body are fully engaged to one another.

7. The utility knife handle of claim 1 or 2, wherein: said first body includes a protective member extending above an outer surface of said first body adjacent a blade opening on said blade holding portion thereof; and said second body includes a protective member extending above an outer surface of said second body adjacent a blade opening on said blade holding portion thereof.

8. The utility knife handle of claim 1 or 2, wherein: said blade storing portion of said first body includes an alignment member having a beveled terminal end surface; and said blade storing portion of said second body has a hole, said beveled terminal end surface being adapted to mate with said hole and align said alignment member within said hole when said first body and said second body are joined.

9. The utility knife handle of claim 1 or 2, wherein: said blade storing portion of said first body has a protruding member adapted to extend through an aperture in a blade; and said blade storing portion of said second body has a recessed portion adapted to receive said protruding member when said utility knife handle is in a closed position in which said first body and said second body are fully engaged to one another.

10. The utility knife handle of claim 9, wherein said recessed portion of said second body is adapted to receive said protruding member when said utility knife handle is in an intermediate position in which said first body and said second body are separated from one another by a predetermined distance.

11. The utility knife handle of claim 9, wherein:

said protruding member extends to a predetermined height; and said first body includes peripheral walls about said blade storing portion that extend to a height substantially equivalent to said predetermined height of said protruding member.

12. The utility knife handle of claim 1, wherein said blade holding portion of said first body has a second stop adapted to abut a rear edge of the blade when the blade is positioned on said second key.

13. A utility knife handle comprising:

a first shell adjustably mated to a second shell to form a blade holding portion located at a first end and an internal blade storing cavity located at a second end, said first shell and said second shell having mating beveled surfaces adapted to align said first shell with said second shell when said first shell and said second shell are connected; wherein:

said blade holding portion of said first shell has a first key adapted to extend through an aperture in a blade positioned thereon;

said blade holding portion of said second shell has a groove adapted to receive said first key when said utility knife handle is in the closed position; and said blade holding portion of said second shell has a first stop adapted to abut a rear edge of the blade when the blade is positioned on said first key.

14. The utility knife handle of claim 13, wherein said first shell is connected to said second shell by a control knob having a threaded rod extending therefrom, said rod extending through an aperture in said second shell and engaging a threaded hole on said first shell, said control knob being positioned between said blade holding portion and said blade storing cavity.

15. The utility knife handle of claim 13, wherein: said blade storing cavity of said first shell has a protruding member adapted to extend through an aperture in a blade to a predetermined height;

said blade storing cavity of said second shell has a recessed portion adapted to receive said protruding member when said utility knife handle is in the closed position, said recessed portion of said second shell is further adapted to receive said protruding member when said utility knife handle is in the intermediate position; and said first shell includes peripheral walls about said blade storing cavity that extend to a height substantially equivalent to said height of said protruding member.

16. The utility knife handle of claim 13, wherein:

said blade storing cavity of said first shell includes an alignment member having a beveled terminal end surface; and said blade storing cavity of said second shell has a hole, said beveled terminal end surface being adapted to mate with said hole and align said alignment member within said hole when said first shell and said second shell are joined.

17. The utility knife handle of claim 13, wherein:

said blade holding portion of said first shell has a second key adapted to extend through the aperture in the blade positioned thereon, said second key extending to a height below a height of said first key;

said groove being adapted to receive said second key when said utility knife handle is in the closed position, and said groove being adapted to receive said first key when said utility knife handle is in the intermediate position; and said blade holding portion of said first shell has a second stop adapted to abut the rear edge of the blade when the blade is positioned on said second key.

* * * * *